US008069789B2

(12) United States Patent
Hummel et al.

(10) Patent No.: US 8,069,789 B2
(45) Date of Patent: Dec. 6, 2011

(54) CONNECTOR FOR ELECTRONIC DETONATORS

(75) Inventors: Dirk Hummel, Hennef (DE); Thomas Boos, Niederkassel (DE)

(73) Assignee: Orica Explosives Technology Pty Ltd, Melbourne, Victoria (AU)

( * ) Notice: Subject to any disclaimer, the term of this patent is extended or adjusted under 35 U.S.C. 154(b) by 1017 days.

(21) Appl. No.: 10/598,906

(22) PCT Filed: Mar. 16, 2005

(86) PCT No.: PCT/AU2005/000373
§ 371 (c)(1),
(2), (4) Date: Sep. 14, 2006

(87) PCT Pub. No.: WO2005/090895
PCT Pub. Date: Sep. 29, 2005

(65) Prior Publication Data

US 2007/0207669 A1 Sep. 6, 2007

Related U.S. Application Data

(60) Provisional application No. 60/553,954, filed on Mar. 18, 2004.

(51) Int. Cl.
*F42B 3/12* (2006.01)
*F42B 3/26* (2006.01)
*F42B 3/103* (2006.01)

(52) U.S. Cl. ..... 102/202.12; 102/202.14; 102/202.9; 102/275.12

(58) Field of Classification Search ..... 102/200, 102/202.5, 202.9, 202.12, 202.14, 206, 217, 102/275.12; 439/604, 606
See application file for complete search history.

(56) References Cited

U.S. PATENT DOCUMENTS

| | | | |
|---|---|---|---|
| 1,458,740 | A | 6/1923 | Wells |
| 2,763,211 | A | 5/1951 | Balckburn |
| 2,767,655 | A | 10/1956 | Seavey |

(Continued)

FOREIGN PATENT DOCUMENTS

| | | |
|---|---|---|
| EP | 0208480 | 1/1987 |

(Continued)

OTHER PUBLICATIONS

Supplementary European Search Report, European Application No. EP 05714246, 3 pages, Sep. 22, 2010.

*Primary Examiner* — James S Bergin
(74) *Attorney, Agent, or Firm* — Fish & Richardson P.C.

(57) ABSTRACT

Fire, arm, and disarm signals are typically transmitted to electronic detonators via signal transmission lines. Traditionally, such signal transmission lines include wires wherein one end of each wire is soldered directly to printed circuit boards and/or other signal processing components retained within the shell of a detonator. Other 'modular' blasting apparatuses of the prior art provide means to connect signal transmission lines to detonators in the field. Signal transmission line/detonator contacts are susceptible to disruption, particularly when the signal transmission lines are subject to inadvertent tugging or tensile forces at the blast site. The present application discloses an electrical connector that enables secure connection between a signal transmission line and any detonator adapted to receive and optionally process electrical signals from the signal transmission line. Specifically, the electrical connector can be affixed to the signal input end of a detonator, and includes at least one bridge element to provide electrical contact between a signal transmission line, and internal electrical component(s) of the detonator.

19 Claims, 4 Drawing Sheets

U.S. PATENT DOCUMENTS

| | | | | | |
|---|---|---|---|---|---|
| 2,991,714 | A | | 7/1961 | Noddin | |
| 3,776,135 | A | | 12/1973 | Zebree | 102/29 |
| 3,897,131 | A | * | 7/1975 | Stauffer | 439/655 |
| 4,331,079 | A | | 5/1982 | Bajohr et al. | 102/202.12 |
| 5,259,782 | A | | 11/1993 | Giffin | 439/367 |
| 5,327,835 | A | | 7/1994 | Adams et al. | |
| 5,334,025 | A | | 8/1994 | Föhl | 439/188 |
| 5,392,712 | A | | 2/1995 | Waldock | 102/275.12 |
| 5,423,261 | A | | 6/1995 | Bernardy et al. | |
| 5,460,549 | A | * | 10/1995 | Muzslay | 439/733.1 |
| 5,503,077 | A | | 4/1996 | Motley | |
| 5,585,591 | A | | 12/1996 | Waldock | 102/202.12 |
| 5,595,497 | A | * | 1/1997 | Wood | 439/282 |
| 5,596,163 | A | | 1/1997 | Caflisch et al. | 102/202.2 |
| 5,596,164 | A | | 1/1997 | Waldock | 102/202.9 |
| 5,648,634 | A | | 7/1997 | Avory et al. | |
| 6,082,264 | A | | 7/2000 | Meyer et al. | 102/202.9 |
| 6,085,659 | A | | 7/2000 | Beukes et al. | 102/206 |
| 6,146,598 | A | * | 11/2000 | Duvacquier et al. | 422/166 |
| 6,655,289 | B1 | | 12/2003 | Bornheim et al. | 102/202.12 |

FOREIGN PATENT DOCUMENTS

| | | |
|---|---|---|
| EP | 0547443 | 6/1993 |
| EP | 0717259 | 6/1996 |
| FR | 1246888 | 11/1960 |
| GB | 22594 | 12/1910 |
| GB | 414147 | 8/1934 |
| GB | 414670 | 8/1934 |
| GB | 735407 | 8/1955 |
| GB | 2018959 | 10/1979 |
| GB | 2315118 | 1/1998 |
| WO | 98/39615 | 9/1998 |

* cited by examiner

CONNECTOR FOR ELECTRONIC DETONATORS

FIELD OF THE INVENTION

The present invention relates to detonators for use in a blasting network. Specifically, the present invention relates to blasting apparatuses comprising detonators configured to receive one or more electrical signals from attached signal transmission lines, and devices for secure physical and electrical connection of the signal transmission lines to detonators.

BACKGROUND TO THE INVENTION

Blasting operations frequently trigger a series of explosions in an exact order, with precise timing. For this purpose, blasting apparatuses can employ electronic detonators that may be initiated to fire in response to electrical signals transferred thereto by signal transmission lines. Typically, electronic detonators are positioned as desired to form a blasting array, each being connected to a blasting machine. The blasting machine may communicate directly with a single detonator or multiple detonators in the array via selected signal transmission lines (including for example trunk lines and/or branch lines or by wireless communications means). Communication signals may include, but are not limited to, ARM, DISARM, and FIRE signals, and may also include security code information such as firing codes to prevent inadvertent or illicit detonator initiation.

Safety and reliability are paramount for any blasting apparatus, and efficient detonator initiation is an important factor in this regard. Detonators that fail to initiate result in unexploded charges at the blast site, with inevitable safety concerns. Moreover, the reliable initiation of detonators is imperative to ensure that the required blasting pattern is properly effected.

Electronic detonators typically comprise an elongated, often cylindrical casing. At one end of the casing is a percussion-actuation end comprising a flat, shaped or hemispherical surface. Adjacent the surface is positioned a base charge. The signal transmission line enters the detonator casing at a signal input end of the detonator usually opposite the percussion-actuation end. The detonator casing may also house various components required for proper signal processing and detonator control. For example, such components may include, but are not limited to, one or more printed circuit boards, means for signal processing, means for storing detonator firing code information, and means for arming, disarming and initiating firing of the base charge.

Signal transmission lines may transmit signals between a blasting machine and one or more detonators via electrical communication. Alternatively, signal transmission lines may extend from components of a wireless detonator assembly (e.g. a wireless signal transmission or receiving means) to the main detonator unit, thereby to transmit electronic signals to or from the detonator and other wireless assembly components. In any event, signal transmission lines generally include two (or more) wires in juxtaposition. Each wire must be connected to the detonator for proper operation thereof. Moreover, each signal transmission line is preferably suited for two-way communication between the blasting machine and the detonator. In this way, the status of individual detonators as well as firing codes and logging information, can be monitored by an associated blasting machine.

Traditionally, the wires of the signal transmission lines are soldered directly to circuit elements of signal processing means retained within the detonator shell. Such signal processing means may include, but are not limited to, printed circuit boards (PCBs), which may be involved in receipt, analysis, processing or relay of the incoming signal(s). In this way, the wires from the signal transmission line enter into the detonator shell at the signal input end of the detonator.

For example, U.S. Pat. No. 6,085,659 issued Jul. 11, 2000, discloses an electronic explosives initiating connector which includes a firing element which has a designed no-fire voltage and an operating circuit which operates at any voltage in a range of voltages that straddles the no-fire voltage. The connector pertains to an electronic detonator including a housing for containing the primary explosive and other components for detonator operation. The detonator includes a header and an integrated circuit, which together function to process incoming signals from a signal transmission line. The housing is crimped at one end to a crimp plug. Electrical leads extend from the integrated circuit through the crimp plug and to the exterior of the detonator to form the signal transmission line. The presence of the crimp plug in the detonator system of U.S. Pat. No. 6,085,659 acts as a seal to protect the components inside the housing against the ingress of moisture and dirt.

Whilst simple to manufacture, such 'traditional' detonator-to-signal transmission line connections present several disadvantages. One particular disadvantage lies in that the wires from the signal transmission line must be properly installed (e.g. by soldering) to the internal components of the detonator in the factory production line setting, and the detonator/signal transmission line assemblies must be shipped accordingly. It is noteworthy that each detonator may be selected from a variety of detonators (for example each having different delay periods or security functions), and each signal transmission line may comprise a desired length. As a result, a large number of possible detonator/signal transmission line combinations are possible, thereby increasing the costs and logistics of product transportation and storage of a range of commercial products.

In another disadvantage, the wires of the signal transmission line are soldered directly onto the printed circuit board or related components of the detonator initiation system. For this reason, the wire/detonator connection can be prone to breakage particularly if tensile or tugging forces are applied to the signal transmission line. Such forces may impose directly on the wire/detonator connection at the printed circuit board. The resulting disruption or breakage of the corresponding contacts can result in detonator failure in the field, with inevitable safety concerns.

To overcome at least some of the disadvantages of the prior art, "modular" detonator systems have been developed that include, for example, plug and socket means or junction boxes to allow positive attachment of signal transmission lines to detonators at the blasting site. In this way, the detonators (including the base charges) can be shipped to a customer and conveyed to the blasting site separately from the signal transmission lines. This results in improved safety and logistics of transporting and handling the components of the blasting apparatus.

For example, related U.S. Pat. No. 5,392,712 (issued Feb. 28, 1995), U.S. Pat. No. 5,585,591 (issued Dec. 17, 1996), and U.S. Pat. No. 5,596,164 (issued Jan. 21, 1997) disclose a detonator assembly for use with a booster charge. The assembly includes an electrical detonator and two electrical leads of equal length. One end of each lead is connected to the electrical detonator, and the other end of each lead is connected to a connector. The connector capable of maintaining the ends of the two electrical leads in non-conductive condition, and this allows the splicing of an additional leg wire thereto without the use of stripping or crimping tools. In this way, the desired length of wire can be spliced to the detonator assembly in the field. Moreover, the detonators may be conveniently packaged for transportation and storage.

In another example, U.S. Pat. No. 6,655,289 issued Dec. 2, 2003 discloses trigger units for initiating pyrotechnic elements, which usually consist of a switch and control unit, ignition means and an ignition charge body. The invention pertains to the use of a switch and control unit surrounded by a first shell, wherein the first shell is connected to a second shell, which contains the ignition charge body. The design is suited to efficient automatic assembly. In specific embodiments, the patent discloses a plug and socket system for the attachment of signal transmission lines to detonators. The detonator may include a percussion-actuation end and a plug located at the opposite end from the percussion-actuation end. The plug includes pins extend from the detonator, and which include connections to the printed circuit board. Importantly, the pins are adapted for engagement with a corresponding plug socket located at the end of a signal transmission line.

The safety of blasting apparatuses, and in particular electronic blasting apparatuses, is of paramount importance. There remains a continual need to develop electronic blasting apparatuses that include features that improve both reliability and safety. This need especially extends to the integrity of the blasting network, and communication between the components of the network. Most particularly, the connections between the signal transmission lines and the detonators encompass a key feature of the blasting network. Poor or weak connections can result in a failure to initiate specific detonators or groups of detonators within a blasting network, with deleterious effects upon the blasting sequence and the overall blasting event.

SUMMARY OF THE INVENTION

It is an object of the present invention, at least in preferred embodiments, to provide a connector for secure connection of a signal transmission line either to an electronic detonator, or at least to one or more electronic components either within or intended for use in a detonator that is initiated by an electrical signal.

It is another object of the present invention, at least in preferred embodiments, to provide a connector for substantially preventing unwanted disruption of a signal transmission line/detonator connection by a tensile force applied to the signal transmission line.

In the field, electronic detonators and associated signal transmission lines are prone to disruption. Typically, unwanted tensile or tugging forces can impose considerable loading strains upon detonator/signal transmission line contacts. While measures can be taken to prevent such loading strains, a degree of loading is often unavoidable due to the arrangement and general establishment of the blasting network. Moreover, persons setting up the blasting network may be unsympathetic to the loading strains on the signal transmission lines.

In one aspect, the present invention provides for a connector that improves the security of connections between signal transmission lines and electronic detonators. Through detailed experimentation, the inventors of the present invention have developed a connector that may be suitably affixed to a detonator preferably adapted to receive the connector. Preferably, the connector is affixed on a non-actuating end of a detonator. Such a connection avoids the need for direct connection between the component wires of a signal transmission line and an electrical component of an electronic detonator. The connector confers significant durability to the signal transmission line/detonator connection, particularly with respect to tensile forces applied to the signal transmission line. In effect, the connector can substantially prevent breakage of the electrical contact and retain physical association between a signal transmission line and components of a detonator, even in the presence of fairly high tensile forces. Moreover, the connector of the present invention avoids the need for complex junction blocks or plug/plug socket systems of the prior art, and may be used, at least in preferred embodiments, in modular blasting apparatuses.

In one aspect the present invention provides an electrical connector for secure retention of a signal transmission line to a detonator, the detonator having an opening provided for connection to said signal transmission line and being adapted to initiate in response to one or more electrical signals received via the signal transmission line, the electrical connector comprising:

a body of electrically insulating material adapted to form a plug member for said opening of said detonator;

at least one bridge element comprising electrically conductive material extending through said plug member and having parts that emerge from said plug member; and retaining means for retaining each of said at least one bridge element in said plug member to cause said at least one bridge element to resist slippage between said at least one bridge element and said plug member.

Preferably, each retaining means comprises a part of said at least one bridge element in contact with said insulating material, said part comprising at least one surface that extends at an angle to a direction of force applied to said at least one bridge element by pulling or tugging one of said parts that emerge from said plug member, thereby causing said at least one bridge element to resist slippage between said at least one bridge element and said plug member.

Preferably, each retaining means bonds or clamps said at least one bridge element within said plug member.

Preferably said parts that emerge from said plug member, emerge on opposite sides thereof.

Preferably said at least one bridge element comprises a first end and a second end, each first end being adapted for attachment to a signal transmission line, and each second end being adapted for contact with an electrical component of the detonator. More preferably, each first end comprises a wire clasp or crimp for grasping the end of a wire emerging from the signal transmission line. Preferably, said electrical component is selected from the group consisting of: a printed circuit board or a component thereof, means to allow protection from electrostatic damage to other electronic components of the detonator, a resistor, a varistor, a zener diode, a suppressor diode, an encapsulated integrated circuit, an SO8 packaging, a filter, a capacitor, a spark gap, a small outline integrated circuit, and a rectifier, or alternatively said electrical component is connected to a printed circuit board or a component thereof, means to allow protection from electrostatic damage to other electronic components of the detonator, a resistor, a varistor, a zener diode, a suppressor diode, an encapsulated integrated circuit, or an SO8 packaging, a printed circuit board or a component thereof, a resistor, a filter, a capacitor, a spark gap, a small outline integrated circuit, or a rectifier. Preferably said at least one bridge element comprises a metal, a metal alloy, a ceramic, a rigid polymer, or a semiconductor. More preferably, said at least one bridge element consists of a metal. More preferably, said at least one bridge element is formed by stamping a template, from sheet metal.

Preferably said part of said at least one bridge element that is in contact with said insulating material is adapted for abutment, impalement or engagement with an internal surface of said plug member, thereby to serve as the retaining means to retain said at least one bridge element in position within said plug member. More preferably, application of a pulling or tugging force to one of said parts that emerge from said plug member, causes said portion adapted for abutment, impalement or engagement with said internal surface of said plug member to impart a resistive force upon said internal surface, thereby causing each bridge element to resist slippage between each bridge element and said plug member.

Preferably said part of said at least one bridge element that is in contact with said insulating material comprises a bent, sinusoidal, coiled or stepped portion configured for interaction with an internal surface of the plug member. More preferably, said part of said at least one bridge element that is in contact with said insulating material comprises a portion comprising at least one barb, hook or spike for impalement into an internal surface of the plug member. Preferably, said at least one bridge element comprises a first end and a second end, each first end being adapted for attachment to a signal transmission line, and each second end being adapted for contact with an electrical component of the detonator, each barb, spike, or hook extending in a direction generally away from said second end.

Preferably each retaining means comprises a portion of each bridge element having a convoluted path through said plug member such that the at least one bridge element frictionally engages the plug member to retain said at least one bridge element within the plug member.

Preferably each retaining means is introduced into the plug member as a settable material and is set.

Preferably the plug member includes a portion adapted to extend into and frictionally engage with an internal surface of the shell of the detonator at said opening thereof.

Preferably the plug member further includes an annular recess to receive a detonator crimp, thereby to secure said plug member at said opening of the detonator.

Preferably the plug member includes a threaded portion for threaded engagement with an internal surface of the detonator at said opening thereof.

Preferably the body of electrically insulating material comprises at least one bend and said at least one bridge element comprises at least one corresponding bend thereby to cause engagement therebetween, so as at least to assist in retention of said at least one bridge element within said plug member.

Preferably, the electrical connector of the invention, further comprises a sheath element for sheathing at least one electrical connection between said signal transmission line and said at least one bridge element, the sheath element comprising:

(a) an elongate body adapted for association at one end thereof with the electrical connector; and (b) a longitudinal bore extending therethrough for receiving the signal transmission line and at least a portion of each bridge element. More preferably, the sheath element is at least partially made of a flexible material. Preferably, the sheath element is adapted for releasable engagement with the electrical connector such that the sheath element can be selectively disengaged from the electrical connector to expose said at least one bridge element and/or said at least one electrical connection. Preferably, the sheath element is permanently fixed to the electrical connector. Preferably, the sheath element and the electrical connector are unitary in construction. Preferably, the sheath element further comprises one or more transverse ridges along the body to impart flexibility to the sheath element. Preferably, the sheath element further comprises a flex point defined by a narrow portion of the elongate body. Preferably, the releasable engagement is provided by a friction fit or an interference fit.

In another aspect, the present invention provides for a sheath element for connection to the electrical connector of the present invention, said sheath element for sheathing electrical connections between said signal transmission line and said at least one bridge element, said sheath element comprising:

(a) an elongate body adapted for association at one end with the electrical connector; and (b) a longitudinal bore extending therethrough for receiving the signal transmission line and at least a portion of each bridge element. Preferably, the sheath element is at least partially made of a flexible material. Preferably the sheath element is adapted for releasable engagement with the electrical connector such that the sheath element can be selectively disengaged from the electrical connector to expose said at least one bridge element and/or said at least one electrical connection. Preferably, the sheath element is permanently fixed to the electrical connector. Preferably, the sheath element and the electrical connector are unitary in construction. Preferably, the sheath element further comprises one or more transverse ridges along the body to impart flexibility to the sheath element. Preferably, the sheath element further comprises a flex point defined by a narrow portion of the elongate body. Preferably, the releasable engagement is provided by a friction fit or an interference fit.

In another aspect the invention provides for an assembly comprising the electrical connector of the present invention, in combination with at least one electrical component of a detonator, said at least one bridge element in electrical contact with said at least one electrical component. Preferably, said electrical component is selected from the group consisting of: a printed circuit board or a component thereof, means to allow protection from electrostatic damage to other electronic components of the detonator, a resistor, a varistor, a zener diode, a suppressor diode, an encapsulated integrated circuit, an SO8 packaging, a filter, a capacitor, a spark gap, a small outline integrated circuit, and a rectifier, or alternatively said electrical component is connected to a printed circuit board or a component thereof, means to allow protection from electrostatic damage to other electronic components of the detonator, a resistor, a varistor, a zener diode, a suppressor diode, an encapsulated integrated circuit, or an SO8 packaging, a printed circuit board or a component thereof, a resistor, a filter, a capacitor, a spark gap, a small outline integrated circuit, or a rectifier. Preferably, said at least one bridge element is soldered to at least one circuit element of a printed circuit board.

In another aspect the invention provides for a detonator assembly comprising:

a detonator shell including a percussion-actuation end and an opening at an end opposite said percussion-actuation end;

a base charge adjacent the percussion-actuation end of the shell;

the assembly of the present invention, fixed to said detonator shell at least in part by securing said plug member to said opening, said at least one electrical component being retained within the shell, said at least one bridge element including a part that emerges from said plug member within said shell for electrical contact with said at least one electrical component, and a part that emerges from said plug member and extends away from said shell for electrical contact with a signal transmission line; and initiation means associated with said at least one electrical component for transfer of one or more appropriate initiation signals to the base charge for actuation thereof in response to appropriate signal(s).

DEFINITIONS

Figure 1:
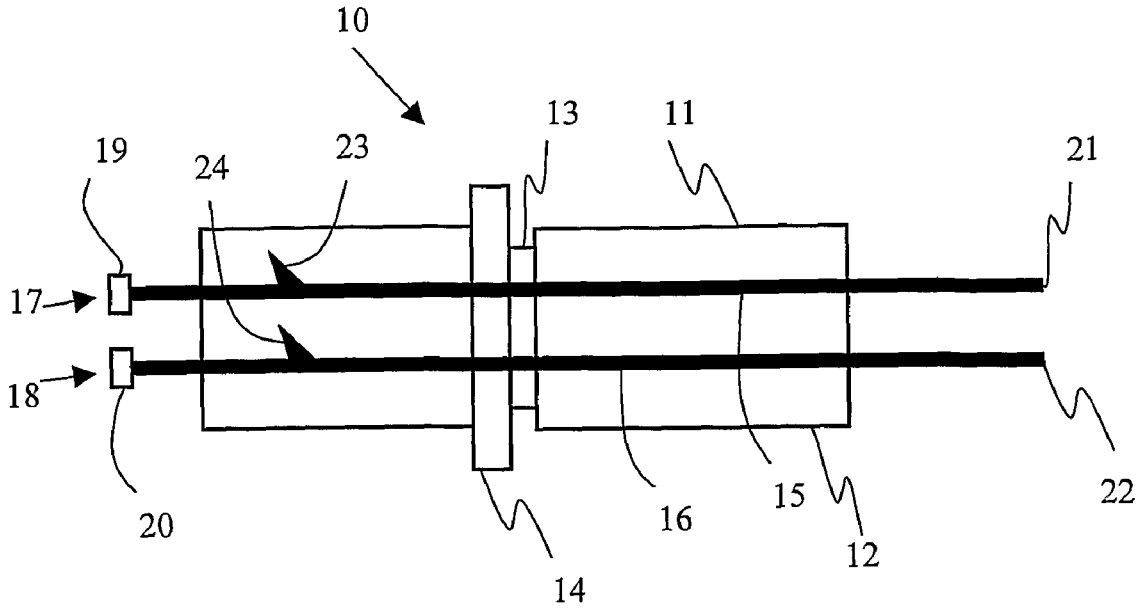
FIG. 1 provides for a cross sectional view of a preferred electrical connector of the present invention.

Blasting apparatus: For the purposes of this specification, a blasting apparatus may include one or more blasting machines and associated detonators. The blasting apparatus may further include additional components such as one or more blasting machines, and optionally a central control unit or central command station. The detonators and other components of a blasting apparatus may communicate via physical means such as electrical wires, low energy detonating cord, or shock tube, or alternatively may communicate via wireless means such as radio waves, electromagnetic induction or light (e.g. laser light) signaling means. The expressions 'blasting system' and 'blasting apparatus' are essentially synonymous on the understanding that they may include various physically joined or separate components working on conjunction with one another to control and optionally actuate detonators.

Blasting machine: a device in signal communication with one or more detonators, for arming, disarming, and firing detonators via the receipt and/or relay of signals transmitted from a central command station. A typical blasting machine may be in communication with one or more detonators or groups of detonators via wireless-communication or direct physical connection (e.g. low energy detonating cord, shock tube, or electrical connection (i.e. signal transmission line)). The term blasting machine also encompasses a device that itself generates command signals, or detonator firing codes, typically in blasting apparatuses that do not employ a central command station. A blasting machine may also be capable of receiving and processing information from detonators associated therewith, including firing codes, delay times, and information regarding the position and conditions of detonators. Blasting machines may themselves be assigned a unique identification to differentiate each blasting machine from every other blasting machines in the blasting apparatus or system. Typically, an identification code may be semi-permanently assigned to a blasting machine for a predetermined time period, or for the lifetime of the blasting machine.

Base charge: refers to any discrete portion of explosive material in the proximity of other components of the detonator and associated with those components in a manner that allows the explosive material to actuate upon receipt of appropriate signals from the other components. The base charge may be retained within the main casing of a detonator, or alternatively may be located nearby the main casing of a detonator. The base charge may be used to deliver output power to an external explosives charge to initiate the external explosives charge.

Central command station: any device that transmits signals via radio-transmission or by direct connection, to one or more blasting machines. The transmitted signals may be encoded, or encrypted. Typically, the central command station permits radio or other communication with multiple blasting machines from a location remote from the blast site.

Signal transmission line: any electrically conductive line which provides communication for electronic signal between a detonator and some other component of a blasting apparatus. Such other component may include a blasting machine (thereby to provide direct electronic signal communication between a blasting machine and the detonator) or such other component may include a component of a wireless detonator assembly. For example, having regard to the latter wireless embodiment, such other component may form part of a wireless signal receiving and/or transmitting means that may be located, for example, remote from the detonator unit, for example in a top-box at or above a surface of the ground. The signal transmission line may be used to transmit command signals such as FIRE, ARM and DISARM commands from an associated blasting machine to one or more detonators or electronic components thereof. A signal transmission line may also transmit signals from a detonator to a blasting machine including but not limited to detonator code signals, firing code signals, delay time signals, and signals regarding the environment of the detonator.

Bridge element: means an elongate body of electrically conductive material suitable for providing electrical contact between a corresponding wire from a signal transmission line, and an electrical component of an electronic detonator. The bridge element may comprise any material or combination of materials suitable for conducting electricity. Such materials may include, for example, a metal, a metal alloy, a ceramic conductor, a conductive polymer or a semiconductor. Preferably, the bridge element may simply comprise a length of metal. In particularly preferred embodiments the "bridge element" may comprise a substantially firm, a substantially inflexible, a resiliently flexible or a deformable section of metal, rather than a supple or pliable length of metal such as a metal wire. Most preferably, the "bridge element", if made out of metal, is formed by cutting or stamping a region of metal sheeting. In embodiments where the bridge element comprises a non-metallic material, the bridge element preferably comprises a substantially firm, a substantially inflexible, a resiliently flexible or a deformable section of non-metallic material. The bridge element may take any shape, form, or configuration providing firstly that it is capable of providing electrical contact between a wire of a signal transmission line and an electrical component of an electronic detonator, and secondly that it is amenable to secure retention within a plug member in accordance with the electrical connector of the present invention. Some example bridge element configurations are illustrates in FIGS. 5*a* to 5*k*.

Electrical component: relates to an internal component of an electronic detonator positioned in electrical contact with the signal transmission line. The term electrical component includes any component that may be used in conjunction with a base charge in a detonator to orchestrate firing, arming, or disarming of the detonator, or which receives, transmits or processes signals such as for example signals received from or sent to an associated blasting machine. Such electrical component may include but is not limited to, an electrical component selected from the group consisting of: a printed circuit board or a component thereof, means to allow protection from electrostatic damage to other electronic components of the detonator, a resistor, a varistor, a zener diode, a suppressor diode, an encapsulated integrated circuit, an SO8 packaging, a filter, a capacitor, a spark gap, a small outline integrated circuit, and a rectifier, or alternatively said electrical component is connected to a printed circuit board or a component thereof, means to allow protection from electrostatic damage to other electronic components of the detonator, a resistor, a varistor, a zener diode, a suppressor diode, an encapsulated integrated circuit, an SO8 packaging, a printed circuit board or a component thereof, a resistor, a filter, a capacitor, a spark gap, a small outline integrated circuit, or a rectifier. Where a detonator comprises more than one electrical component, such electrical components may be connected to a signal transmission line, an electrical connector, or base charge in series or in parallel. Electrical components discussed herein may be independent to or form part of a printed circuit board.

Electronic detonator: relates to any detonator that comprises an internal base charge, wherein the base charge is capable of initiation in response to one or more incoming electrical signal(s), received for example from a signal transmission line via the electrical connector of the present invention. Such electronic detonators may include, for example, detonators comprising signal processing means, initiation means, and a base charge, wherein the signal processing means may include one or more printed circuit boards. However, the expression 'electronic detonator' as used in this specification also encompasses more traditional electric detonators that may lack complex signal processing means, and which simply initiate upon receipt of an incoming electrical signal. Such traditional electric detonators may optionally include a delay fuse to provide some degree of control over the timing of detonator initiation.

Flex point: generally refers to any point in a sheath member as disclosed hereinof the present invention where flexing of the sheath member is more easily enabled relative another portion of the sheath. Standard methods for generating a flex point include by pinching the sheath or by inserting an annular recess in the body of the sheath thereby decreasing the cross section of the sheath which results in facilitated flexing or pivot of the sheath. Another method of generating facilitated flexing is by reducing the amount of material which makes up the body of the sheath thereby weakening the sheath at the point where flexing is desired.

Modular: in the context of the present disclosure refers to detonators and detonator systems having the capacity to be assembled in the field. Signal transmission line or equivalent may be connected to each detonator in the field, such that detonators with attached Plug or Plug member: pertains to an element shaped for interaction with an opening at a signal line receiving end of a detonator. Typically a plug will fit within the end of the detonator shell, and preferably be shaped for frictional engagement therewith. A plug may further comprise a recess such as an annular recess to receive a crimp of a detonator as a means for plug retention. In accordance with the present invention, a plug is adapted for extension therethrough of one or more bridge elements, such that in use one end of each bridge element extends into the shell of the detonator, and the other end of each bridge element preferably extends to the exterior to the detonator shell, for connection with a corresponding wire from a signal transmission line. The plug material itself is generally comprised of an electrically non-conductive material, which may typically be formed from molded plastic, rubber or other material. Therefore, the term 'plug' encompasses a member that preferably, but not necessarily, seals the signal line receiving end of the detonator from ingression of water and dirt into the detonator shell.

Preferably: identifies preferred features of the invention. Unless otherwise specified, the term preferably refers to preferred features of the broadest embodiments of the invention, as defined for example by the independent claims, and other inventions disclosed herein.

Retaining means: refers to any means for securing a bridge element in a desired position within a plug member in an electrical connector of the invention, such that the bridge element substantially cannot be dislodged or displaced from its desired position either by hand manipulation of the bridge element or by the application of tugging forces transferred to the bridge element via one or more associated signal transmission lines. For example, a retaining means may comprise one or more clamps to clamp the bridge element in position, or a settable material or adhesive that has been set in the vicinity of the bridge element. In other examples, the retaining means may be an inherent feature or an integral part of the bridge element and/or plug member. For example, the retaining means may comprise a hooked, barbed, spiked, bent, coiled, or otherwise convoluted portion of the bridge element, and/or may comprise at least a portion of an inner surface of the plug member adapted to abut, engage or otherwise interact with at least a portion of a bridge element retained therein. Other retaining means are also within the scope of the invention.

Sheath member: refers to any device as disclosed herein suitable for attachment to or forming a part of an electrical connector of the present, for protecting an interface or connection between one or more wires of a signal transmission line with one or more bridge elements. Such a sheath member may take any form and configurations to achieve this goal, and exhibit substantially rigid or substantially flexible properties.

Tugging forces and tensile forces: generally refer to the forces that are intentionally or inadvertently applied to a signal transmission line in the field during blasting operations. In the absence of an electrical connector of the invention such forces may typically be imparted to the connection between the wires of the signal transmission line, and components of the connected detonator when the detonator is fixed in a desired position at the blast site. Tugging or tensile forces generally pertain to those forces that tend to pull the signal transmission line such that contact with the detonator may be broken.

DETAILED DESCRIPTION OF THE INVENTION

The present invention provides, at least in preferred embodiments, for an electrical connector for securing a signal transmission line to a detonator, or at least to one or more initiation components of a detonator. Preferably, the connector may form part of a modular-type electronic detonator apparatus, wherein signal transmission lines are connected to electronic detonators at the blasting site, rather then in the factory setting. In this way, the connector of the present invention presents multiple advantages. The principle advantage pertains to the secure connection of the signal transmission line to the electronic detonator, which substantially prevents breakage of the corresponding connections when a tugging or tensile force is applied to the signal transmission line. Preferred embodiments of the invention exhibit further advantages, which include but are not limited to: the suitability of the connector to generate simple modularized detonator systems, and the capacity of the connector to prevent unwanted ingress of water or dirt into the detonator.

In the field, electronic detonators and associated signal transmission lines are prone to disruption. Typically, unwanted tensile or tugging forces can impose considerable loading strains upon detonator/signal transmission line contacts. While measures can be taken to prevent such loading strains, a degree of loading is often unavoidable due to the arrangement and general establishment of the blasting network. Moreover, persons setting up the blasting network may be unsympathetic to the loading strains on the signal transmission lines.

In one aspect, the present invention provides for a connector that improves the security of connections between signal transmission lines and electronic detonators. Through detailed experimentation, the inventors of the present invention have developed a connector that may be suitably affixed to a detonator preferably adapted to receive the connector. Preferably, the connector is affixed on a non-actuating end of a detonator. Such a connection avoids the need for direct connection between the component wires of a signal transmission line and an electrical component of an electronic detonator, such as for example a printed circuit board or any other electrical components that could form part of a detonator. The connector confers significant durability to the signal transmission line/detonator connection, particularly with respect to tensile forces applied to the signal transmission line. In effect, the connector can substantially prevent breakage of the electrical contact and retain physical association between a signal transmission line and components of a detonator, even in the presence of fairly high tensile forces. Moreover, the connector of the present invention avoids the need for complex junction blocks or plug/plug socket systems of the prior art, and may be used, at least in preferred embodiments, in modular blasting apparatuses.

A preferred embodiment of the invention will be described with reference to FIG. 1. The figure illustrates a connector of the invention shown generally as 10. The connector includes a plug member 11, which comprises an elongate, generally cylindrical molding comprising a material that functions as a good electrical insulator (i.e. a material that is a poor electrical conductor). Preferred materials for the plug member include but are not limited to plastics or resins, including, for example, polyurethane. The plug member 11 is illustrated to comprise a generally cylindrical shape, a first end 12 of which is suited for insertion into the signal input end of a detonator (not shown). For example, the first end 12 of the plug member 11 may be sized for frictional engagement with the signal input end of the shell of a detonator. Other means may be used for securing the plug member 11 at the signal input end of a detonator in addition to, or instead of frictional engagement. For example, the plug member 11 includes an annular recess 13 adapted to receive a crimp portion of a detonator or alternatively for interference fit with a detonator. The plug member may further include a stop, such as an annular rib 14 adapted to abut with the end of a detonator shell at the signal input end of the detonator. Annular rib 14 assists in proper positioning of the electrical connector in the detonator. However, the annular rib is an entirely preferred feature, and any means may be used to position the electrical connector independent of the shape or configuration of the plug member.

It should be noted that although the plug member illustrated in FIG. 1 is generally cylindrical in shape, this pertains to a particularly preferred embodiment of the invention. In alternative embodiments, the plug member may comprise any shape and size, providing that it is adapted for secure retention at the signal input end of a corresponding detonator. Moreover, the plug member and/or the detonator may preferably include any features that assist in the retention of the plug member at the signal input end of the detonator. Moreover, any form of adhesive, glue or resinous material may be used to assist in plug member retention. Preferably, the plug has a size and a configuration that is generally consistent with the dimensions of the detonator. More preferably, the plug member is configured for facile fixation to the shell of a corresponding detonator for example by an automated production line.

Once in position at the signal input end of an electrical detonator, the plug member preferably, but not necessarily, substantially seals the signal input end of the detonator from the ingress of unwanted materials, such as water or dirt. As such, the plug member may further include known sealing means, for example an O-ring. In the field, it is particularly desirable to prevent such materials from infiltrating into the inner workings of the electrical detonator, since the capacity of the detonator for signal processing and base charge initiation may be effected.

With reference again to FIG. 1, extending axially through the plug member 11 are bridge elements 15 and 16. Although FIG. 1 illustrates the presence of two bridge elements the present invention encompasses connectors, and corresponding assemblies that comprise one, two, or more bridge elements. The number of bridge elements extending through the plug member will depend upon the blasting apparatus, and detonators used therein. For example, specific detonators that require complex firing and/security codes may require additional bridge elements to form connections between additional wires from the signal transmission line and components of the detonator's signal processing systems. In use, however, each bridge element will generally be connected to a single component wire of the signal transmission line (see below).

Each bridge element 15 and 16 may comprise any form of electrically conductive material, and may even pertain to a wire comprising a bundle of metallic filaments. In preferred embodiments, each bridge element comprises a single piece of metallic material exhibiting a degree of stiffness, inflexibility, or at least resilient flexibility. Most preferably, each bridge element is cut or stamped from sheet metal, and shaped or molded as necessary. Without wishing to be bound by theory, it is believed that the provision of less pliable bridge elements confers several advantages to the connectors of the present invention. For example, more rigid or more resilient bridge elements are more robust, better suited to form secure electrical connections, and are more easily fixed in position within the plug member (as discussed in more detail below).

Each bridge element 15, 16 includes a first end 17, 18 for contacting a wire from the signal transmission line (not shown). The first end 17, 18 of each bridge element 15, 16 is especially adapted to include a wire retention means for secure connection with each corresponding wire. For example, in FIG. 1 the first end of each bridge element includes means such as a clasp 19, 20, which comprises a portion of metal that can be bent over to trap, retain and maintain electrical contact with the metallic filaments of the corresponding wire. This simple clasp system is particularly preferred, since it can be readily formed when the bridge element is cut or stamped from sheet metal. However, the invention is not limited in this regard. Any suitable wire clasping, crimping, grasping or retention system may be employed by each bridge element to retain a wire in secure electrical contact therewith. Preferably, the wire attachment means may permit facile reversible attachment and detachment of the corresponding wire. In its simplest form, the wire attachment means may comprise a straight portion of the bridge element that can be simply bent into shape to enable attachment to a corresponding wire. In further preferred embodiments, the first end of each bridge element may further comprise a second clasp for clasping any plastic sheathing around the wire, thereby improving the security of the wire/bridge element connection. To this end, the present invention further encompasses, at least in preferred embodiments, a novel wire sheath for use in connection with the connector of the present invention, and will be described in detail below.

In any event, the capacity to affix the end of a wire from the signal transmission line to a corresponding bridge element provides the advantage that the electric connector of the present invention can be incorporated into modularized detonator systems. For example, each electrical connector may be affixed to a corresponding detonator in the factory setting, and shipped accordingly to the blast site. Subsequently, signal transmission lines may be affixed in electrical connection with the detonators, or more specifically to the electrical connectors of the invention secured at the signal input end of each detonator. Therefore, the electrical connectors of the present invention are compatible with either modularized blasting apparatuses, or with more traditional systems in which the signal transmission lines are connected to the detonator assembly on a factory production line.

The second ends 21, 22 of each bridge element (preferably opposite the first ends) are designed to make electrical contact with a component of the signal processing system of the detonator, such as for example circuit elements on a printed circuit board (not shown). In preferred embodiments, the ends of each bridge element are soldered directly to a printed circuit board. However, any means of contact between the second end of each bridge element and the printed circuit board or other electrical components are encompassed within the scope of the invention. In specific embodiments, the invention pertains to an assembly comprising both the electrical connector as described herein, in electrical contact with a printed circuit board and/or other component(s) of the detonator initiation system. Moreover, the invention further encompasses a detonator assembly comprising the electrical connector of the invention as described herein, in electrical contact with a printed circuit board or other component(s) of the signal processing system, together with a detonator shell, a base charge and initiation means for actuating the base charge in response to appropriate signals.

The electrical connectors of the present invention are particularly suited for use with complex electronic detonators comprising fragile internal components such as printed circuit boards and other signal processing means. However, the electrical connectors may also be used with blasting apparatuses that employ more traditional, less complex detonators. Such 'traditional' detonators may include 'instant' detonators that simply comprise, for example, a shell, an explosive charge, and means for direct electrical contact between the signal transmission line (or electrical connector) and the base charge. Alternatively, such 'traditional' detonators may further include a delay fuse or equivalent between the signal line input end and the base charge for providing some degree of control over the timing of detonator initiation. In any event, the use of the electrical connector of the present invention with such 'traditional' detonators confers similar advantages as for more complex detonators. These advantages include improved robustness of the signal transmission line to detonator contact, and reduced ingress of water, dirt, or other foreign materials into the casing of the detonator at the signal line input end.

In the embodiment illustrated in FIG. 1, each bridge element 15, 16 includes a barb 23, 24 comprising a portion of metallic material extending at an angle relative to the main section of the bridge element, wherein the pointed end of each barb impales an internal surface of the plug member. As a result, each bridge element is held very securely within the plug member. Most preferably, each bridge element will be held so fast within the plug member that even the application of a significant manual force to dislodge the bridge element will be unsuccessful. In use, the electrical contact between the signal transmission line and the initiation components of the detonator will be maintained, even if significant tugging forces are applied to the signal transmission line. The integrity of the blasting apparatus will be far less susceptible to a loss of detonator function due to breakage of contact with a corresponding signal transmission line.

Figure 2:
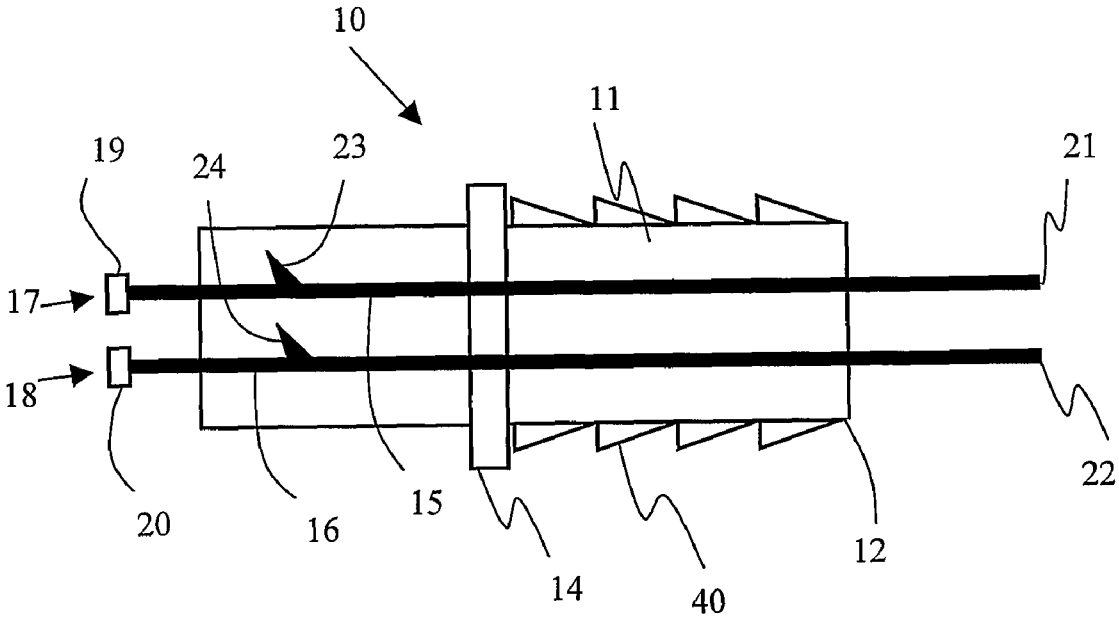
FIG. 2 provides for a cross sectional view of another preferred electrical connector of the present invention.

Shown in FIG. 2 is the cross-sectional view of another embodiment of an electrical connector of the invention. The connector is substantially identical to that illustrated in FIG. 1, accept in that the plug member 11 utilizes a friction engagement for retention in a signal input end of the shell of a detonator (not shown). In the embodiment illustrated in FIG. 2, a series of resilient ribs 40 around the periphery of the plug member flexibly engage with the signal input end of a detonator, thus securing the connector to the detonator. Preferably, the ribs 40 are shaped such that egress of the connector requires substantially more force than ingress of the connector. In addition to the resilient ribs 40, a crimp or interference fit may also be used. In such an arrangement, the electrical connector may further include the annular recess shown in FIG. 1.

Figure 3:
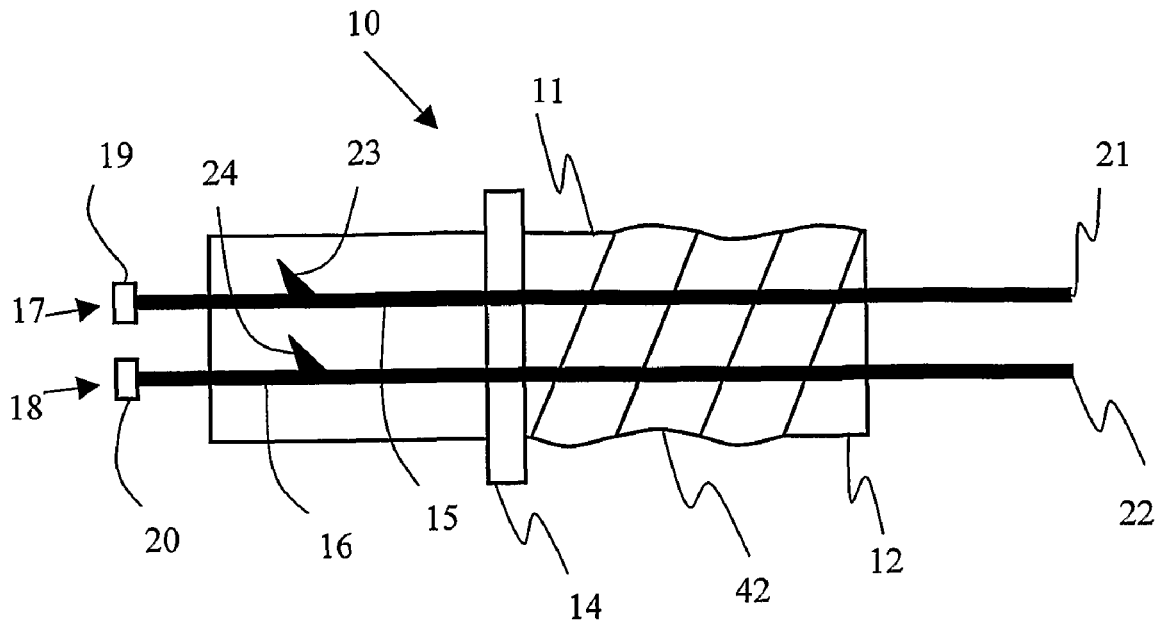
FIG. 3 provides for a cross sectional view of another preferred electrical connector of the present invention.

Shown in FIG. 3 is a cross-sectional view of another embodiment of an electrical connector of the invention. The connector is similar to those illustrated in both FIGS. 1 and 2. In the embodiment shown in FIG. 3, a threaded plug 42 is used to provide for means to attach the connector to a signal input end of the shell of a detonator (not shown). The detonator is adapted to receive the threaded plug 42 thus enabling securing of the electrical connector to the detonator.

Figure 4:
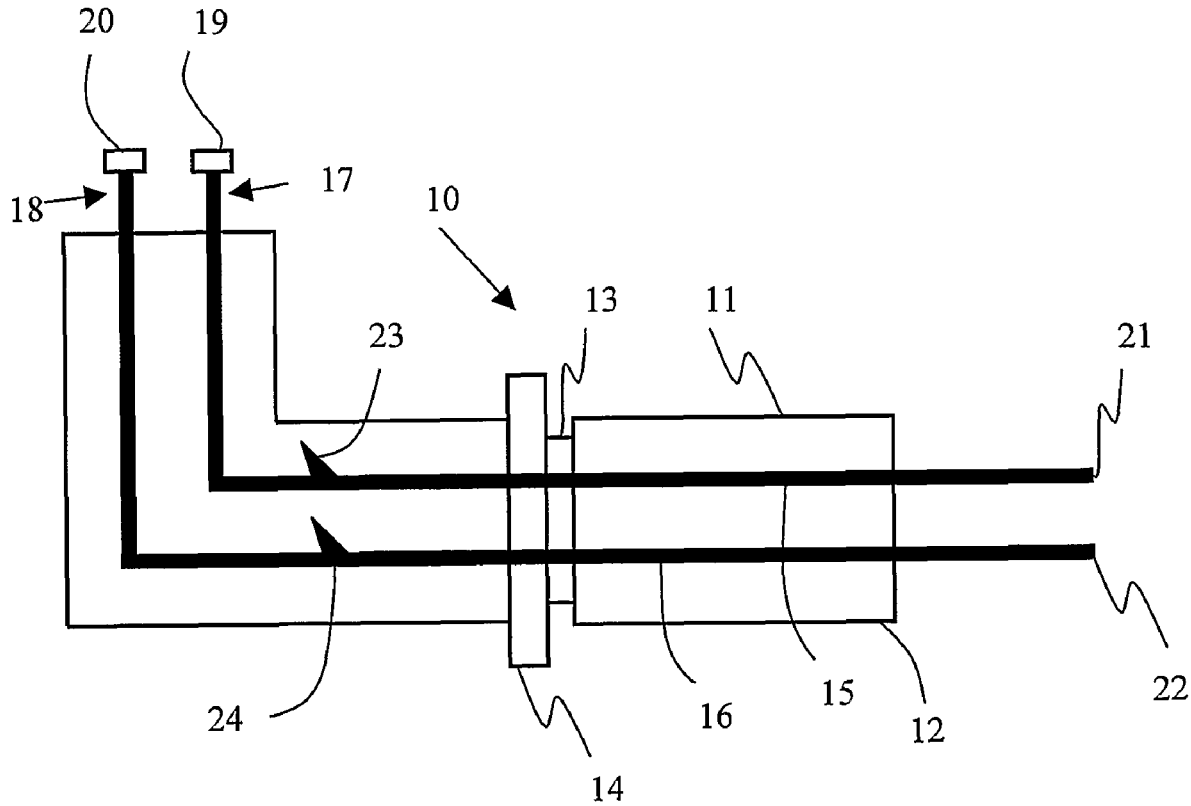
FIG. 4 provides for a cross sectional view of another preferred electrical connector of the present invention.

Shown in FIG. 4 is a cross-sectional view of another embodiment of a connector of the invention. The connector employs a similar friction engagement plug member 11 as that of the embodiment shown in FIG. 1. However, the connector comprises a bend. The bend may be manufactured into the connector to facilitate manipulation of the signal transmitting wires or simply because of circumstance. The bend in the connector results in a bend in the bridging elements 15, 16. As will be discussed below, such a bend, either in addition to or in place of the barbs 23, 24, increases the ability of the electrical connector to retain each bridge element in position. Preferably, each bent portion imparts a force onto one or more regions of the internal walls of the plug member/connector, thereby helping to fix the bridge element in position, and assisting in the security of bridge element retention.

The embodiment illustrated in FIG. 4, shows a ninety degree bend in the connection. It will be appreciated that any number of bends or degree of bend will aid retaining each bridge element in position and connectors having such bends are encompassed by the present invention.

Figure 5:
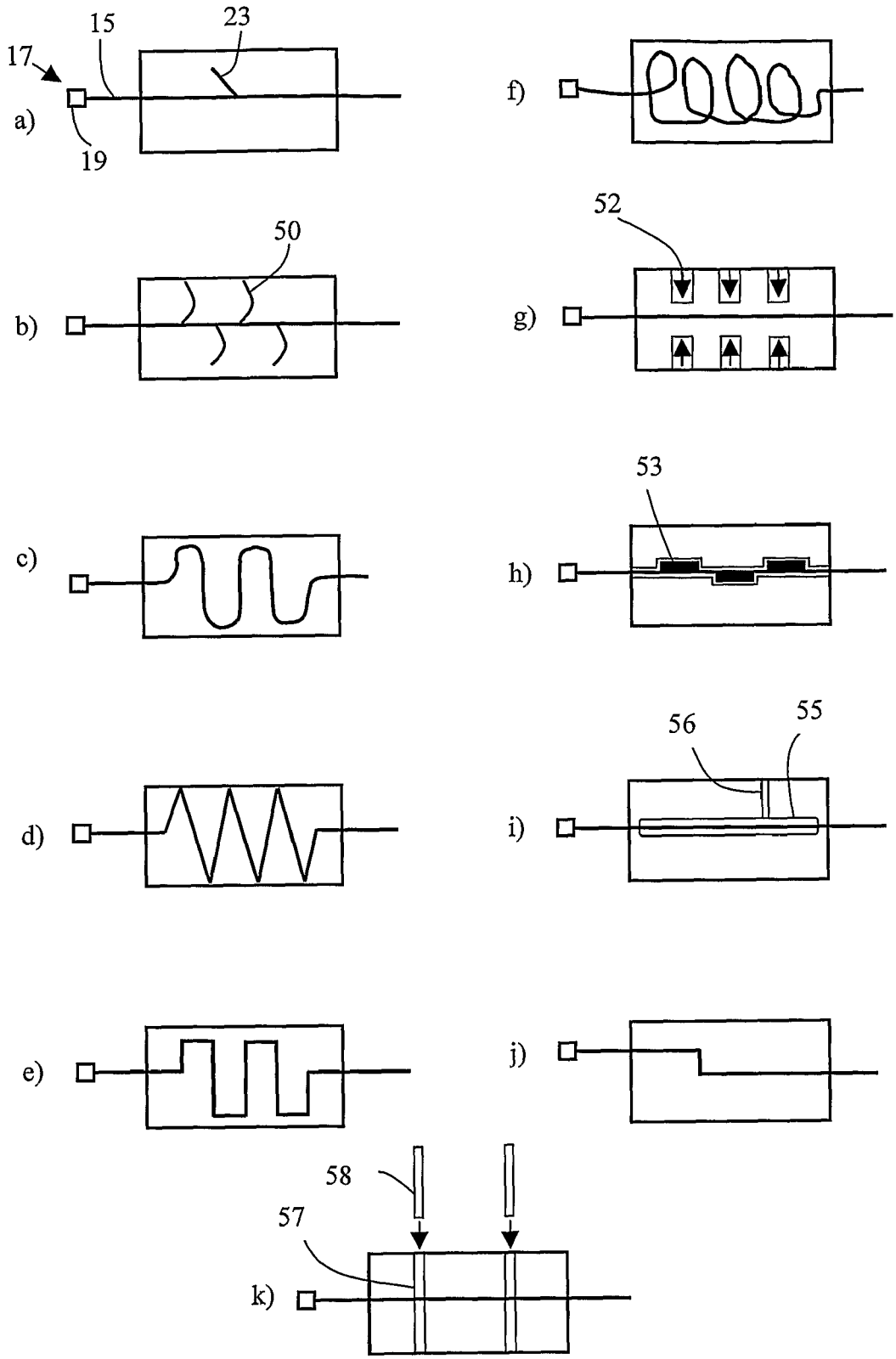
FIG. 5*a* provides a side elevation view in partial cross-section to schematically illustrate an embodiment of the electrical connector of the present invention.
FIG. 5*b* provides a side elevation view in partial cross-section to schematically illustrate an embodiment of the electrical connector of the present invention.
FIG. 5*c* provides a side elevation view in partial cross-section to schematically illustrate an embodiment of the electrical connector of the present invention.
FIG. 5*d* provides a side elevation view in partial cross-section to schematically illustrate an embodiment of the electrical connector of the present invention.
FIG. 5*e* provides a side elevation view in partial cross-section to schematically illustrate an embodiment of the electrical connector of the present invention.
FIG. 5*f* provides a side elevation view in partial cross-section to schematically illustrate an embodiment of the electrical connector of the present invention.
FIG. 5*g* provides a side elevation view in partial cross-section to schematically illustrate an embodiment of the electrical connector of the present invention.
FIG. 5*h* provides a side elevation view in partial cross-section to schematically illustrate an embodiment of the electrical connector of the present invention.
FIG. 5*i* provides a side elevation view in partial cross-section to schematically illustrate an embodiment of the electrical connector of the present invention.
FIG. 5*j* provides a side elevation view in partial cross-section to schematically illustrate an embodiment of the electrical connector of the present invention.
FIG. 5*k* provides a side elevation view in partial cross-section to schematically illustrate an embodiment of the electrical connector of the present invention.

Although FIGS. 1, 2 and 3 illustrates the presence of barbs 23, 24 to secure the bridge elements 15, 16 in the plug member 11, it is important to note that the invention is not limited in this regard. Any form of appropriate means may be used to securely retain each bridge element in position within the plug member. A few examples of such means are illustrated in FIG. 5, which should not be considered exhaustive. In each example, the electrical connector is shown in side elevation view and for ease of illustration only a single bridge element 15 is illustrated extending through the plug member. At the first end 17 of each bridge element 15 is shown a metal clasp 19.

FIG. 5*a* illustrates a preferred embodiment of the invention that is similar if not identical to FIG. 1, wherein the electrical connector includes a barb 23, which impales into an internal surface of the plug member. Although less preferred, it would be possible for the barb member to extend 'backwards' towards the second end of the electrical connector. Moreover, each bridge element may include more than one barb. FIG. 5*b* pertains to a similar embodiment to that shown in FIG. 5*a*, wherein the bridge element comprises a series of hooks 50, each hook impaling an internal surface of the plug member.

In contrast to the embodiments shown in FIGS. 5*a* and 5*b*, the embodiments illustrated in FIGS. 5*c* to 5*f* include a bridge element comprising a sinusoidal, zigzag, bent, or coiled portion. In each case, the shaped portion of the bridge element helps to secure the bridge element within the connector/plug member. Preferably, the shaped portion imparts a force onto one or more regions of the internal walls of the plug member, thereby helping to fix the bridge element in position, and assisting in the security of bridge element retention. The specific shape of the shaped portion of the bridge element is generally not critical, providing that the bridge element is substantially prevented from being dislodged from the plug member upon manual manipulation thereof.

Further embodiments of the invention are illustrated in FIGS. 5*g* to 5*k*. In FIG. 5*g* the bridge element is generally linear in shape. The retention of the bridge element is assisted by clamps 52 integral with the plug member. Each clamp 52, applies a force to a portion of the bridge element within the plug member, thereby to hold the bridge element in position and substantially prevent axial or lateral movement thereof relative to the plug member. In FIG. 5*h* the bridge element includes one or more projections 53 that are adapted to engage into one or more corresponding recesses within the internal structure of the plug member. In this way, the bridge element is effectively 'locked' in position, such that axial or other displacement is substantially prevented. In FIG. 5*i*, the bridge element is fixed in position within the plug member by an adhesive, glue or resinous material 55. Preferably, the adhesive, glue or resinous material is a settable material that can be injected into position adjacent the bridge element within the plug member via opening 56. In FIG. 5*j* the bridge element comprises a step, which similar to the embodiment of FIG. 5*e*, provides a resistance against the internal surface of the plug member/connector. In the embodiment of FIG. 5*j*, the first and second ends of the bridge element exit on opposing sides of the connector. In the FIG. 5*k*, the connector comprises at least one bore 57 extending transverse the path of the bridge element. The bridge element comprises a hole therein similar in diameter to the bore. The bore and the hole adapted to receive a pin 58 made of non-conductive material which further retains the bridge element in the plug member/connector. An adhesive, glue or resinous material may further be added to secure the pin in position.

As discussed, signal transmission line/detonator connections, particularly soldered connections, are vulnerable to breakage especially when tensile or tugging forces are applied to the signal transmission line. The electrical connectors of the present invention substantially eliminate this possibility, even when significant manual forces are applied to the components of a blasting apparatus during setup at the blast site. In the unlikely event that tensile forces in the signal transmission lines are exceptionally large, then the electrical connectors of the present invention will dramatically improve the reparability of the blasting apparatus. In many systems of the prior art, the wires of the signal transmission line are soldered directly to the printed circuit board or other internal components of the detonator, and disruption of this internal connection is generally irreparable in the field. In contrast, by using the electrical connectors of the present invention the integrity of the internal electrical contacts within the detonator shell is substantially maintained. Any excessive force applied to the signal transmission line (and connected detonator) at the blast site will likely cause breakage in the electrical contact at the position of clasp (or equivalent) holding the end of the corresponding wire one end of the bridge element. This loss of connection can be easily noted upon visual inspection of the blasting apparatus by an operator, and repairs can be made accordingly. Effectively, the use of the electrical connector of the present invention results in the transfer of a "weak point" in the connection between the signal transmission line and the detonator from a point of contact within the detonator shell to a point of contact outside of the detonator shell. As discussed, this aspect confers many advantages to detonator apparatuses that employ the electrical connector, and corresponding assemblies, of the present invention.

As noted above, the connector of the present invention essentially moves the "weak point" of the connection between the signal transmission line and the detonator to a point exterior the detonator, where the signal transmission line and the bridge element are connected. With this in mind, the invention further provides in preferred embodiments for a sheath element for attachment to, or to form an integral part of, the exposed end of the connector which protects and reinforces the connection point between the signal transmission line and the bridge element(s).

Figure 6:
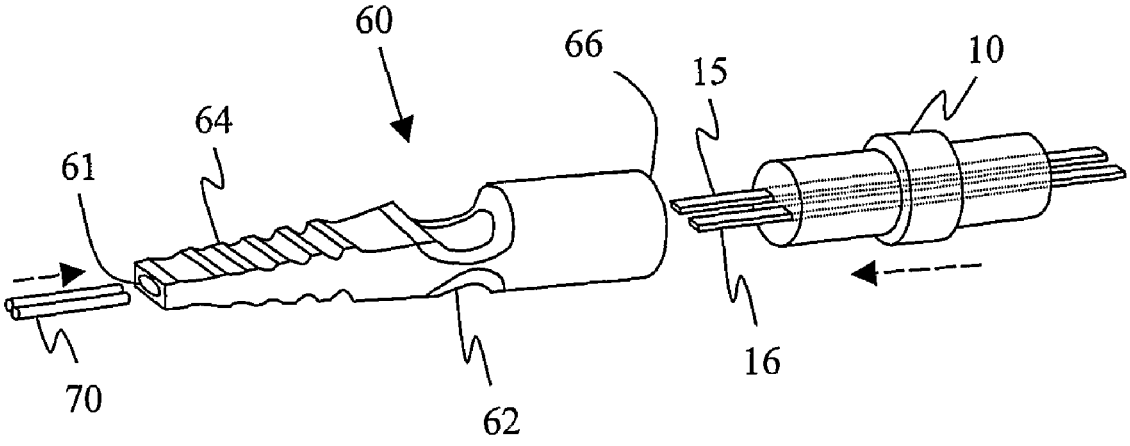
FIG. 6 provides a perspective view of one embodiment of a sheath member of the present invention connected to the electrical connector of the present invention.

An example sheath element is shown in FIG. 6, secured to a connector 10 of the present invention. The sheath element 60 is also shown generally in FIG. 7 in a perspective view. The sheath element has an elongate body. At one end 66 of the sheath element, the body is adapted to releasably secure to a connector of the present inventor by known means, for example interference fit or friction secure. More specifically, once the plug member of the connector has been inserted into the detonator, the exposed portion of the connector may be adapted to mate with the sheath element. In one exemplary embodiment, a male/female type connector is used, whereby the male connector is inserted into the female sheath element and the sheath element is releasably secured by, for example, a friction fit or interference fit.

The end opposite the end adapted to secure to the connector has an opening 61 for receiving the signal transmission line 70. The reinforcing sheath contains at least one bore extending longitudinally therethrough adapted to receive the signal transmission line therein. In one exemplary embodiment, the signal transmission line is slid through the sheath element, the sheath element is slid along the line at least until the line protrudes an amount substantial enough to allow attachment to the bridge element(s) 15, 16. Subsequently, the sheath element is slid back, over the electrical connection between the line and bridge element(s) and is releasably secured to the connector.

The connection between the sheath and the connector is preferably substantially water tight and the opening 61 in the sheath for receiving the signal transmission line is preferably as small as possible thereby substantially preventing the ingress of water and/or dirt and other contaminants into the sheath.

The sheath element is preferably flexible and may contain a flex point 62 whereby flexing of the sheath element is facilitated by a pinch or the like in the sheath element. The sheath element may alternatively or additionally contain a flex point defined by annular recess or annular pinch. The sheath element may also contain one or a series of lateral ribs 64, which serve to both allow some flexing of the sheath element and to facilitate gripping the sheath element. It will be appreciated that movement of the flex point as well as the degree of flexibility of the sheath element and the flex point will result in varying degrees of reinforcement of the connection. Further, one of skill in the art may vary the degree of flexibility of the sheath element by manufacturing the sheath from a variety of materials having their own flexibility characteristics. It is intended that the present invention encompass sheath elements of various materials and designs having varying degrees of flexibility. Moreover, the sheath elements may comprise one or more flex point to facilitate flexing in one or more directions.

The elongated nature of the sheath element combined with the flexibility and protective envelopment of the connection between the signal transmission line and the bridge element (s) effectively reinforces weak points in the connection between the signal transmission line and the detonator. The sheath element preferably prevents vectors of tugging and tensile forces from being directly applied to the "weak point" connection. The releasably secured nature of the connection between the sheath and the connector ensures that if the electrical connection between the signal transmission line and the bridge element(s) is broken, the sheath may be disconnected from the connector and slid up the transmission line to allow reconnected or maintenance to the electrical connection between the signal transmission line and the bridge element(s).

In alternative embodiments the sheath element may be permanently fused with the plug member of an electrical connector of the present invention, or may form an integral part of the electrical connector of the present invention. For example, the plug member and sheath element may be formed by a plastic or metal moulding or casting process to generate a unitary item exhibiting the features and characteristics or the plug member and sheath element in combination.

Figure 7:
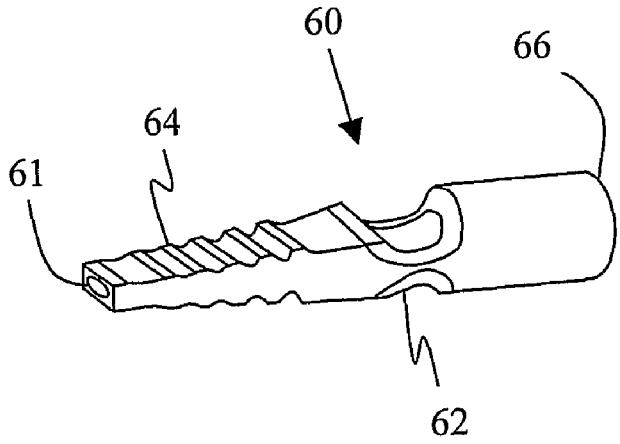
FIG. 7 provides a perspective view of one embodiment of a sheath member of the present invention.

The sheath element is illustrated in FIG. 7 to include a generally cylindrical body. However, the invention is intended to cover any shape or configuration of sheath element that fulfills the desired role of the sheath element as described herein.

Alternatively, in yet another exemplary embodiment, the sheath element may be adapted to connect directly to the signal transmission end of a detonator, thereby circumventing the need for attachment to an electrical connector of the present invention. In such a case, the sheath element would serve to distribute transverse tugging or tensile forces applied to the signal transmission line thereby further reinforcing the connection between the signal transmission line and the detonator.

While the invention has been described with reference to particular preferred embodiments thereof, it will be apparent to those skilled in the art upon a reading and understanding of the foregoing that numerous electrical connector designs other than the specific embodiments illustrated are attainable, which nonetheless lie within the spirit and scope of the present invention. It is intended to include all such designs, and equivalents thereof within the scope of the appended claims.

The invention claimed is:

1. A detonator assembly comprising:

a detonator comprising:

a detonator shell including a percussion-actuation end and an opening at an end opposite said percussion-actuation end;

a base charge adjacent the percussion-actuation end of the shell; and initiation means;

wherein the detonator assembly further comprises an electrical connector for secure retention of a signal transmission line to the detonator and comprising:

a body of electrically insulating material adapted to form a plug member for said opening of said detonator shell;

at least one bridge element comprising electrically conductive material extending through said plug member and having a first end and a second end that emerge from said plug member, said at least one bridge element being in electrical contact with at least one electrical component of said detonator; and retaining means for retaining said at least one bridge element in said plug member to cause said at least one bridge element to resist slippage between said at least one bridge element and said plug member;

said electrical connector being fixed to said detonator shell at least in part by securing said plug member to said opening, said at least one electrical component being retained with the detonator shell, said first end of said at least one bridge element emerging from said plug member and extending away from said detonator shell for electrical contact with a signal transmission line and said second end emerging from said plug member within said detonator shell and in electrical contact with at least one electrical component of the detonator;

the initiation means being associated with said at least one electrical component for transfer of one or more initiation signals to the base charge for actuation thereof in response to the signal(s); and the first end of the bridge element being configured to maintain an electrical contact with the signal transmission line, the electrical contact being positioned external to the detonator and the plug member and configured to provide a breakage point for an electrical connection between the signal transmission line and the electrical component of the detonator in the event of an excess force applied to the signal transmission line and the connected detonator to reduce a likelihood of breaking the electrical connection between the signal transmission line and the electrical component of the detonator at a location internal to the detonator or the plug member.

2. The detonator assembly of claim 1, wherein said first end and second end that emerge from said plug member, emerge on opposite sides thereof.

3. The detonator assembly of claim 1, wherein the first end comprises a wire clasp or crimp for grasping the end of a wire emerging from the signal transmission line.

4. The detonator assembly of claim 1, wherein said at least one bridge element comprises a metal, a metal alloy, a ceramic, a rigid polymer, or a semiconductor.

5. The detonator assembly of claim 4, wherein said at least one bridge element consists of a metal and is formed by stamping a template from sheet metal.

6. The detonator assembly of claim 1, wherein the plug member includes a portion adapted to extend into and frictionally engage with an internal surface of the detonator shell at said opening thereof.

7. The detonator assembly of claim 1, wherein the plug member further includes an annular recess to receive a detonator crimp, thereby to secure said plug member at said opening of the detonator shell.

8. The detonator assembly of claim 1, wherein the plug member includes a threaded portion for threaded engagement with an internal surface of the detonator shell at said opening thereof.

9. The detonator assembly of claim 1, further comprising a sheath element for sheathing at least one electrical connection between said signal transmission line and said at least one bridge element, the sheath element comprising:

(a) an elongate body adapted for association at one end thereof with the electrical connector; and (b) a longitudinal bore extending therethrough for receiving the signal transmission line and at least a portion of each bridge element.

10. The detonator assembly of claim 9, wherein the sheath element is at least partially made of a flexible material.

11. The detonator assembly of claim the 9, wherein the sheath element is adapted for releasable engagement with the electrical connector such that the sheath element can be selectively disengaged from the electrical connector to expose said at least one bridge element and/or said at least one electrical connection.

12. The detonator assembly of claim 11, wherein the releasable engagement is provided by a friction fit or an interference fit.

13. The detonator assembly of claim 9, wherein the sheath element is permanently fixed to the electrical connector.

14. The detonator assembly of claim 9, wherein the sheath element and the electrical connector are unitary in construction.

15. The detonator assembly of claim 9, wherein the sheath element further comprises one or more transverse ridges along the body to impart flexibility to the sheath element.

16. The detonator assembly of claim 9, wherein the sheath element further comprises a flex point defined by a narrow portion of the elongate body.

17. The detonator assembly of claim 1, wherein said at least one electrical component is selected from the group consisting of: a printed circuit board or a component thereof, means to allow protection from electrostatic damage to other electronic components of the detonator, a resistor, a varistor, a zener diode, a suppressor diode, an encapsulated integrated circuit, and SO8 packaging, a filter, a capacitor, a spark gap, a small outline integrated circuit, and a rectifier; or alternatively said electrical component is connected to a printed circuit board or a component thereof, means to allow protection from electrostatic damage to other electronic components of the detonator, a resistor, a varistor, a zener diode, a suppressor diode, an encapsulated integrated circuit, or an SO8 packaging, a filter, a capacitor, a spark gap, or small outline integrated circuit, or a rectifier.

18. The detonator assembly according to claim 1, wherein said at least one bridge element is soldered to at least one circuit element of a printed circuit board.

19. The detonator assembly according to of claim 1, wherein said electrical connector is fixed to said detonator shell at least in part by inserting said plug member into said opening of said detonator shell.

* * * * *

UNITED STATES PATENT AND TRADEMARK OFFICE

CERTIFICATE OF CORRECTION

PATENT NO. : 8,069,789 B2
APPLICATION NO. : 10/598906
DATED : December 6, 2011
INVENTOR(S) : Hummel et al.

It is certified that error appears in the above-identified patent and that said Letters Patent is hereby corrected as shown below:

Col. 20, line 8, delete "claim the 9" and insert -- claim 9 --.

Col. 20, line 43, delete "according to" and insert -- of --.

Col. 20, line 46, delete "according to".

Signed and Sealed this
Twenty-first Day of February, 2012

David J. Kappos

David J. Kappos
*Director of the United States Patent and Trademark Office*